US009744383B2

(12) United States Patent
Antonio

(10) Patent No.: US 9,744,383 B2
(45) Date of Patent: Aug. 29, 2017

(54) ROPE DESCENT DEVICE AND METHOD

(71) Applicant: Ishmael Antonio, Rio Rancho, NM (US)

(72) Inventor: Ishmael Antonio, Rio Rancho, NM (US)

(73) Assignee: Roco Rescue, Inc., Baton Rouge, LA (US)

( * ) Notice: Subject to any disclaimer, the term of this patent is extended or adjusted under 35 U.S.C. 154(b) by 0 days.

(21) Appl. No.: 14/203,705

(22) Filed: Mar. 11, 2014

(65) Prior Publication Data

US 2014/0262609 A1 Sep. 18, 2014

Related U.S. Application Data

(60) Provisional application No. 61/783,275, filed on Mar. 14, 2013.

(51) Int. Cl.
*A62B 1/20* (2006.01)

(52) U.S. Cl.
CPC ..... *A62B 1/20* (2013.01)

(58) Field of Classification Search
CPC .... A62B 1/00; A62B 1/14; A62B 1/16; A62B 1/20; A62B 1/06; A62B 35/00; A62B 35/0006; A62B 35/0012; A62B 35/0031; A62B 35/0037; A62B 35/0043; A62B 35/005; A62B 35/0075; A62B 35/0081; A62B 35/0068; A63B 29/02; A63B 27/00
See application file for complete search history.

(56) References Cited

U.S. PATENT DOCUMENTS

| | | | | | |
|---|---|---|---|---|---|
| 1,600,027 | A * | 9/1926 | Welsand | 224/223 |
| 1,721,516 | A * | 7/1929 | Jacobs | 182/9 |
| 1,802,288 | A * | 4/1931 | Strauss | 182/9 |
| 2,166,777 | A * | 7/1939 | Walker | 182/4 |
| 4,243,118 | A * | 1/1981 | Landry | 182/3 |
| 4,266,511 | A * | 5/1981 | Muench | 119/858 |
| 4,579,196 | A * | 4/1986 | Allen et al. | 182/9 |
| 4,712,646 | A * | 12/1987 | Page | 182/9 |
| 5,022,879 | A * | 6/1991 | DiForte | 441/113 |
| 5,090,503 | A * | 2/1992 | Bell | 182/5 |
| 5,109,803 | A * | 5/1992 | Dunham et al. | 119/654 |
| 5,141,074 | A * | 8/1992 | Sulowski et al. | 182/9 |
| 5,174,410 | A * | 12/1992 | Casebolt | 182/3 |
| 5,222,991 | A * | 6/1993 | Bell | 182/9 |
| 5,234,074 | A * | 8/1993 | Bell | 182/9 |
| 5,279,386 | A * | 1/1994 | Cearley | 182/3 |
| 5,351,654 | A * | 10/1994 | Fuentes | 119/770 |
| 5,529,145 | A * | 6/1996 | Allred | 182/107 |
| 6,016,772 | A * | 1/2000 | Noyes | 119/863 |
| 6,357,547 | B1 * | 3/2002 | Kellog et al. | 182/9 |
| 6,532,903 | B2 * | 3/2003 | Prusia et al. | 119/792 |
| 6,533,066 | B1 * | 3/2003 | O'Dell | 182/3 |
| 6,648,101 | B2 * | 11/2003 | Kurtgis | 182/3 |
| 6,883,640 | B2 * | 4/2005 | Kurtgis | 182/3 |
| 6,959,784 | B2 * | 11/2005 | Diggle et al. | 182/9 |
| 6,990,928 | B2 * | 1/2006 | Kurtgis | 119/770 |
| 7,160,167 | B2 * | 1/2007 | Peters | 441/88 |

(Continued)

*Primary Examiner* — Katherine Mitchell
*Assistant Examiner* — Shiref Mekhaeil
(74) *Attorney, Agent, or Firm* — Roy Kiesel Ford Doody & Thurmon

(57) ABSTRACT

A rope descent device and method capable of maintaining a fast but safe descent rate of a user carrying a heavy load or equipment.

19 Claims, 9 Drawing Sheets

(56) References Cited

U.S. PATENT DOCUMENTS

| | | | | | |
|---|---|---|---|---|---|
| D553,801 | S | * | 10/2007 | Palasini | D29/101.1 |
| 7,585,197 | B1 | * | 9/2009 | Merten | 441/80 |
| D613,500 | S | * | 4/2010 | Overton | D3/226 |
| D618,907 | S | * | 7/2010 | Overton | D3/226 |
| D642,747 | S | * | 8/2011 | Marschke et al. | D30/152 |
| 8,016,335 | B2 | * | 9/2011 | McKay | 294/152 |
| D653,028 | S | * | 1/2012 | Willows et al. | D3/226 |
| 8,104,654 | B2 | * | 1/2012 | Overton | 224/581 |
| 8,205,579 | B2 | * | 6/2012 | Pellei | 119/770 |
| 8,360,202 | B1 | * | 1/2013 | Woodard | 182/3 |
| D685,957 | S | * | 7/2013 | Schiffman et al. | D30/153 |
| 8,584,799 | B1 | * | 11/2013 | Dennington | 182/3 |
| D702,894 | S | * | 4/2014 | Bayless | D30/153 |
| 8,887,866 | B2 | * | 11/2014 | Petty et al. | 182/9 |
| 2007/0169457 | A1 | * | 7/2007 | Kijesky | 57/210 |
| 2010/0051381 | A1 | * | 3/2010 | Wydner et al. | 182/5 |
| 2010/0213004 | A1 | * | 8/2010 | Petty | 182/5 |
| 2010/0243372 | A1 | * | 9/2010 | Wilkinson | 182/3 |
| 2012/0260865 | A1 | * | 10/2012 | Nesper | 119/792 |
| 2013/0126269 | A1 | * | 5/2013 | Perner et al. | 182/9 |

* cited by examiner

ROPE DESCENT DEVICE AND METHOD

CROSS-REFERENCE TO RELATED APPLICATION

This application claims the benefit of U.S. Provisional Application No. 61/783,275, filed Mar. 14, 2013. Each patent application identified above is incorporated here by reference in its entirety to provide continuity of disclosure.

BACKGROUND OF THE INVENTION

Field of the Invention

The present disclosure relates to subject matter for descending a rope, and more particularly to a device and method for descending a rope at fast but controlled descent rate.

Description of Related Art

A variety of rope descent systems and methods have been developed for several situations including military, tactical and combat situations. One such method known as "fast roping" is used by military and tactical personnel around the world to descend from a hovering aircraft (e.g. a helicopter) to the ground using a rope that is suspended from the aircraft. A typical fast rope must be of sufficient diameter (about 1-4 inches) to prevent the rope from wildly whipping around due to the down wash of the hovering aircraft while also allowing the user to grip it with his double gloved hands. The rope is also typically provided with a braided or plaited pattern on its outer circumference to make it easier to grip.

Fast roping is a preferred method of insertion over other methods such as rappelling due to its overall efficiency, effectiveness, and ease of installation. The simplicity and speed of fast roping is its greatest attribute. Fast roping allows several users to rapidly descend from the same rope simultaneously. The user simply grips the rope with their gloved hands and feet, and slides down the rope in a similar manner to a fireman sliding down a pole. The simplicity and speed of fast roping is particularly valuable in combat operations because it minimizes the time over the deployment area, which reduces the vulnerability of the aircraft and inserting force to hostile fire.

However, since the user is attached to the rope by only their hands and feet, fast roping carries a certain amount of risk. In particular, safety and load-carrying capabilities. A user runs the risk of either burning their gloved hands from the friction or hurting themselves by descending too fast and hitting the ground hard. In addition, users often carry heavy loads or other equipment during deployment, which adds to the risk of a free-fall accident.

Other traditional rope descent systems and methods (e.g. belay device, rappel rack, etc.) have been developed to counter these risks, however, they can reduce the simplicity and speed of fast roping operations. For example, these systems and methods typically require more setup time and permit only one person to descend from the rope at a time. In addition, a user typically must wear additional specialty equipment such as a harness. Moreover, many systems and methods require the user to deviate from existing descent procedures. These deviations can lead to an increased risk of injury as the "muscle memory" developed from training is unlearned.

Accordingly, a need remains in the art for a more versatile rope descent device and method capable of maintaining a fast but safe descent rate of a user carrying a heavy load or equipment.

BRIEF SUMMARY OF THE INVENTION

An object of this invention is to provide a more versatile rope descent device and method that is capable of maintaining a fast but safe descent rate of a user carrying a heavy load or equipment. Another object of this invention is to provide a rope descent device and method capable of allowing a user to quickly descend the rope without burning their hand(s). Additional objects and advantages of this invention shall become apparent in the ensuing descriptions of the invention.

Accordingly, a rope descent device and method is provided that is capable of maintaining a fast but safe descent rate of a user carrying a heavy load or equipment. In one aspect of the invention, the rope descent device includes an elongated body having a first end and a second end, a first connection node at the first end, a second connection node at the second end, and a force release mechanism secured to the elongated body. The elongated body is configured to frictionally anchor the elongated body to the fast rope, and the force release mechanism is configured to release the frictional anchor.

In another aspect of the invention, the fast rope descent method includes obtaining a rope descent device having an elongated body having a first end and a second end, a first connection node at the first end, a second connection node at the second end, and a force release mechanism secured to the elongated body. Next, the elongated body is positioned around the fast rope. The elongated body is wrapped around the fast rope to create at least two points of frictional engagement between the elongated body and the fast rope. A coupling link is secured to the user and connection nodes. The user then descends the fast rope.

The foregoing brief summary of the invention presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented below.

Additionally, the foregoing has outlined rather broadly the features and technical advantages of the present invention in order that the detailed description of the invention that follows may be understood. Additional features and advantages of the invention will be described hereinafter, which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features, which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE SEVERAL VIEWS OF THE DRAWING(S)

The accompanying drawings illustrate preferred embodiments of this invention. However, it is to be understood that these embodiments are not intended to be exhaustive, nor limiting of the invention. These embodiments are but examples of some of the forms in which the invention may be practiced.

DETAILED DESCRIPTION OF THE INVENTION

Figure 1:
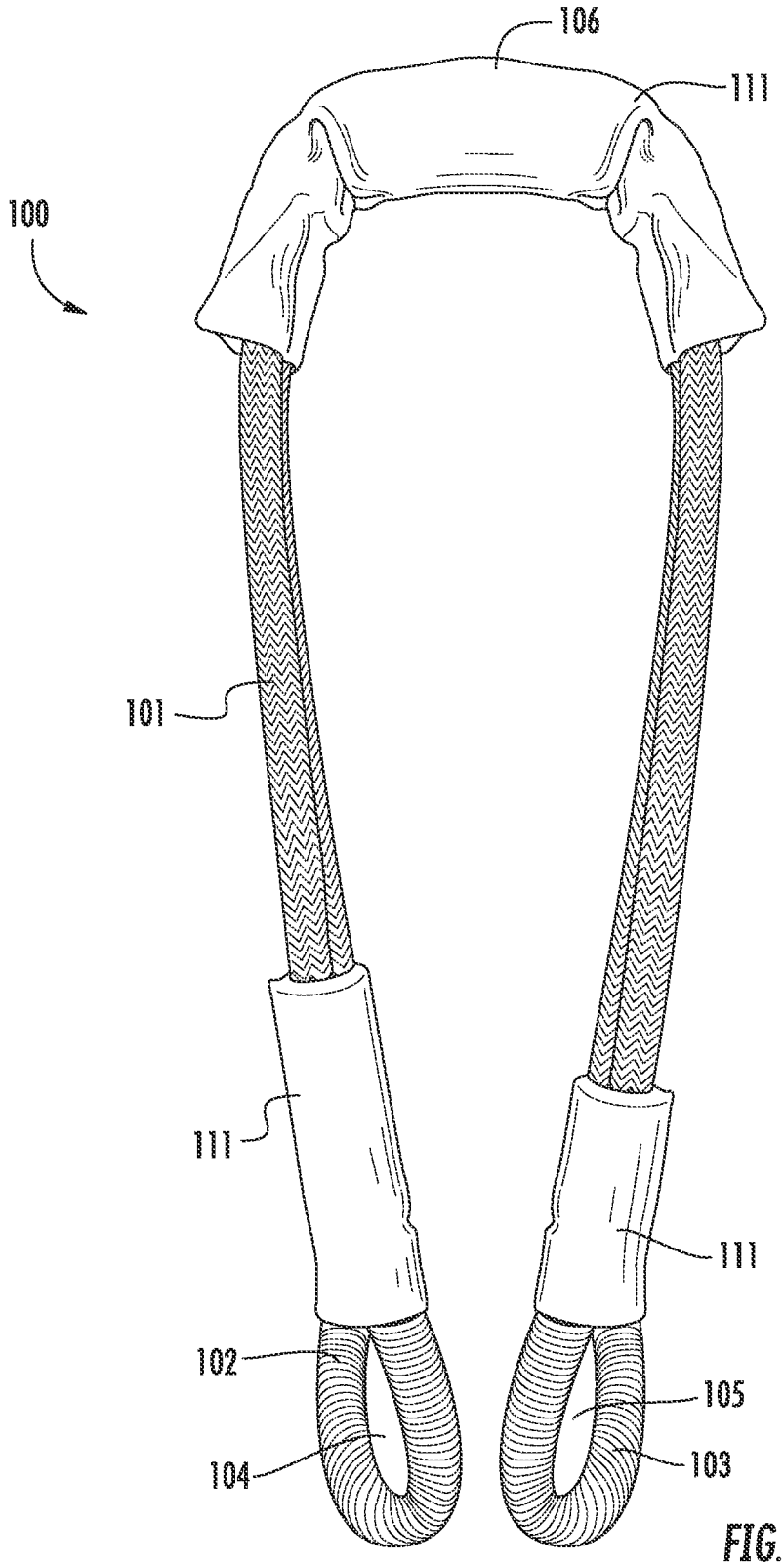
FIG. 1 illustrates an embodiment of a rope descent device in accordance with this invention.
Figure 2:
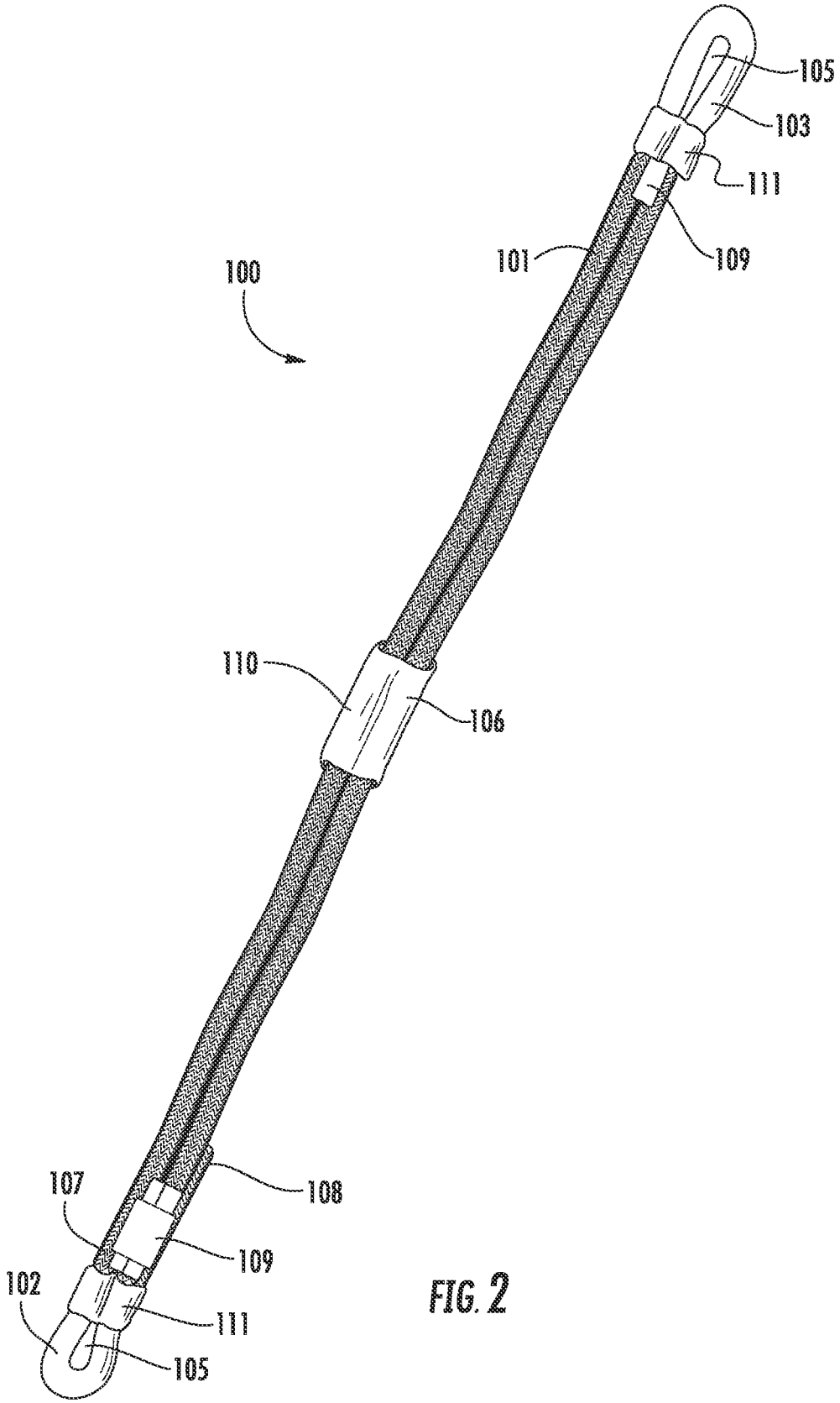
FIG. 2 illustrates the rope descent device shown in FIG. 1 without the cover/sheath surrounding the force release mechanism.
Figure 3:
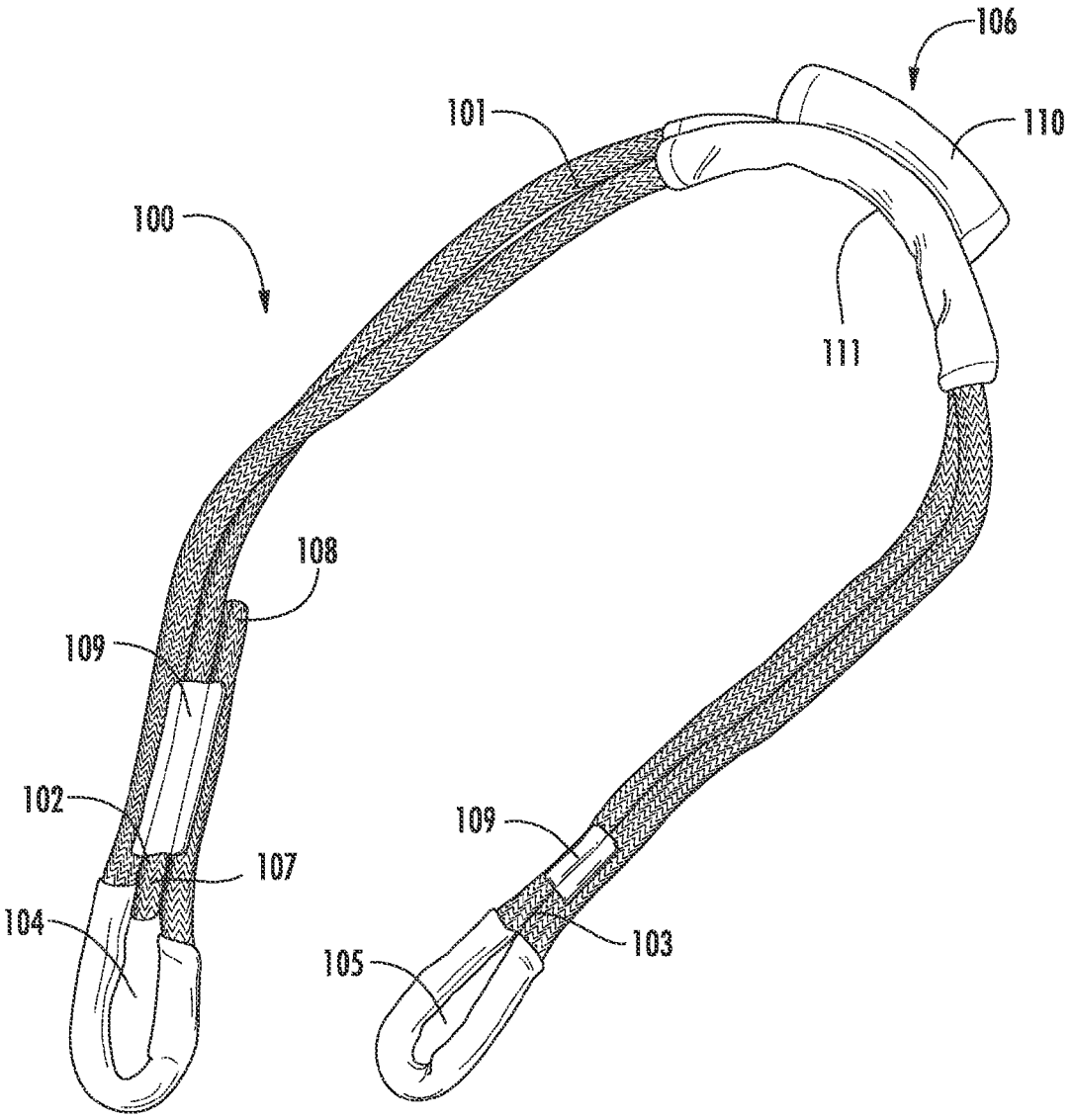
FIG. 3 illustrates an alternate embodiment of a rope descent device in accordance with this invention.
Figure 4:
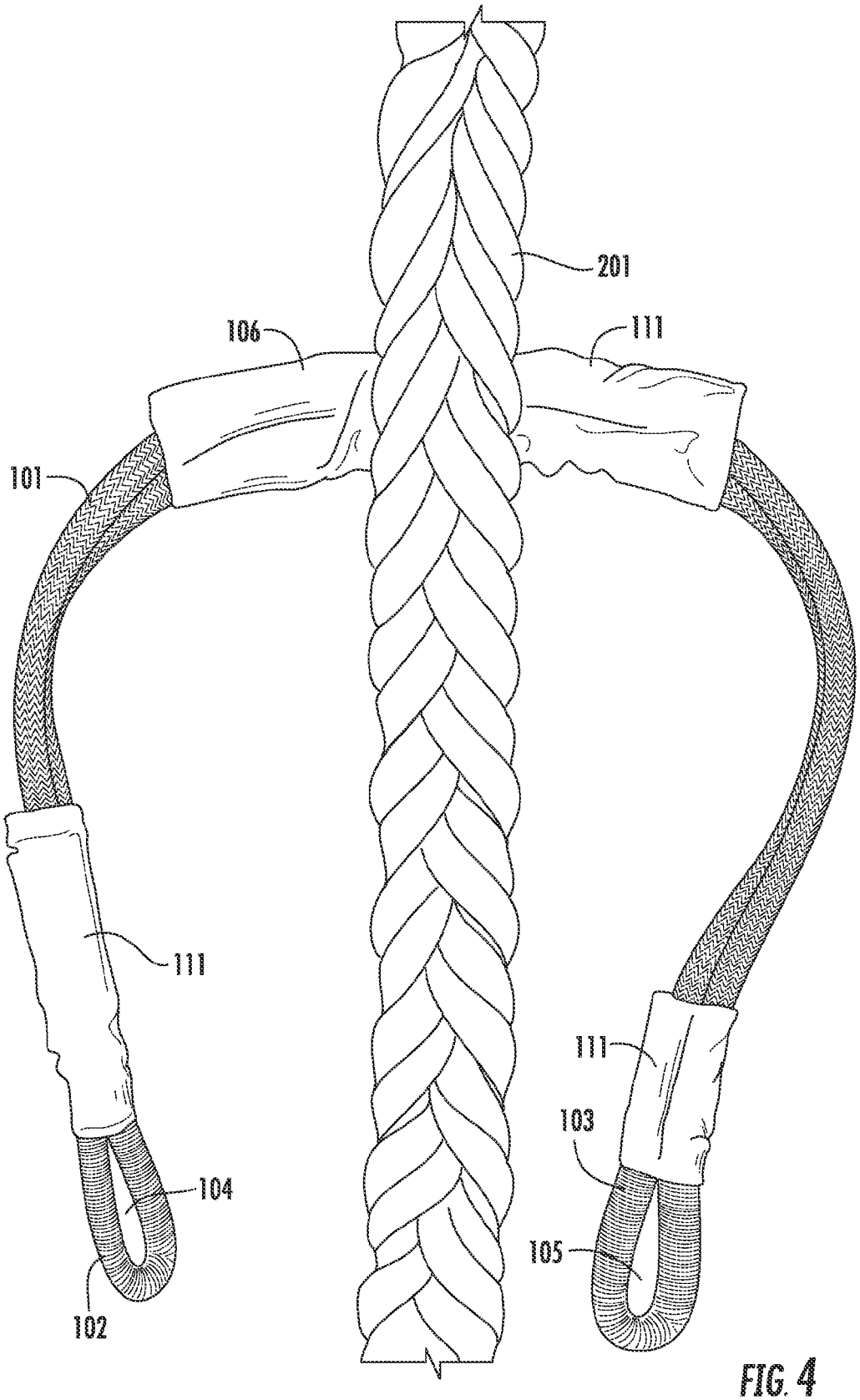
FIGS. 4-9 is illustrates an embodiment of a rope descent device in accordance with this invention in use during a fast roping operation.
Figure 5:
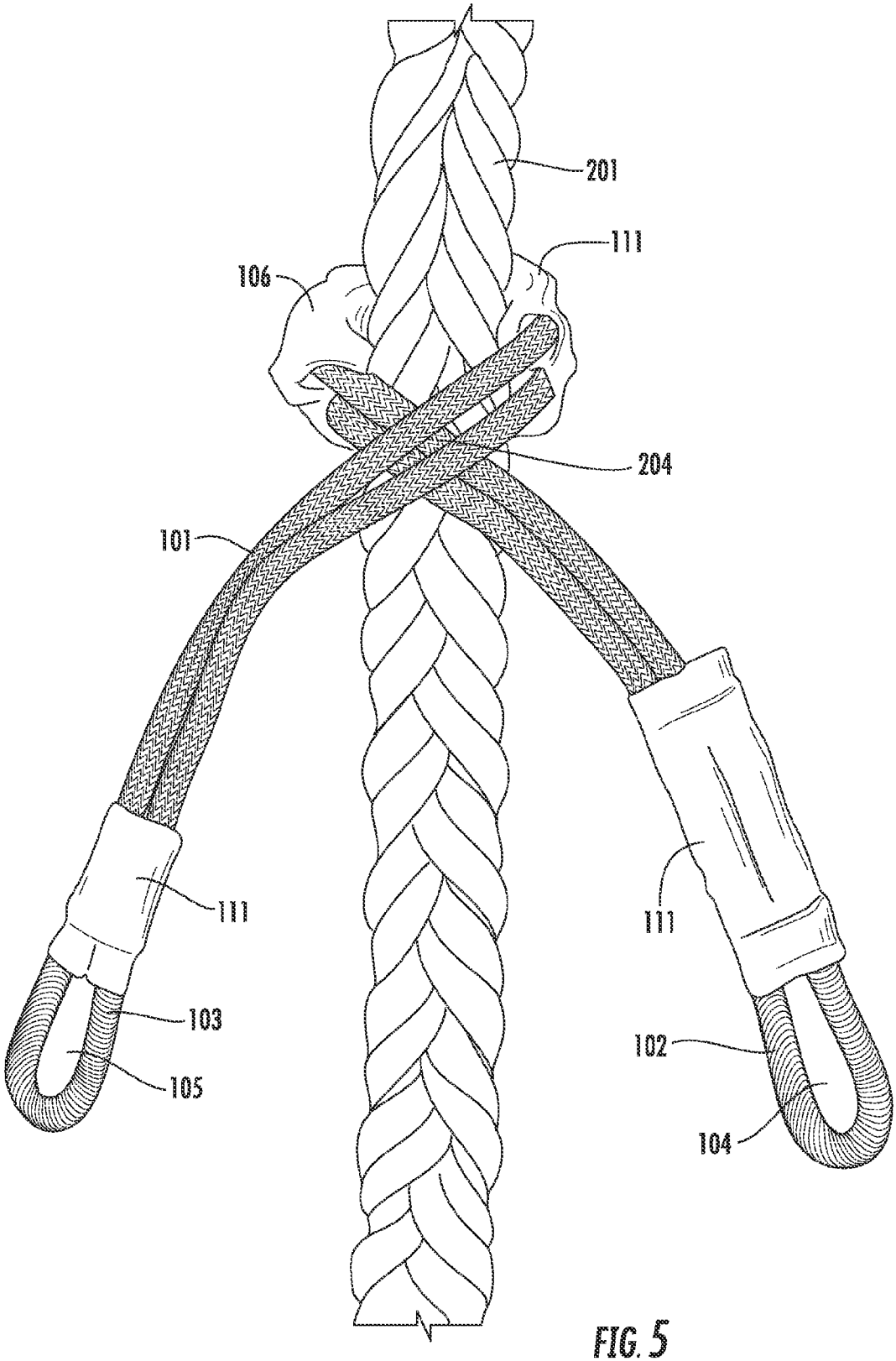

The claimed subject matter is now described with reference to the drawings, wherein like reference numerals are used to refer to like elements throughout. Turning now to FIGS. 1-3, a rope descent device is shown generally at 100. The rope descent device 100 comprises an elongated body 101 having a first end 102 and a second end 103. The rope descent device 100 further comprises a first connection node 104 at the first end 102 of the elongated body 101 and a second connection node 105 at the second end 103 of the elongated body 101. The rope descent device 100 also comprises a force release mechanism 106.

The elongated body 101 is configured so it can be frictionally anchored to a fast rope. In an embodiment, the elongated body 101 comprises a rope having a first terminal 107 and a second terminal 108. The terminal ends 107, 108 are located at the ends of the rope. The first terminal 107 and second terminal 108 are secured to one another to form a sling. The terminals 107, 108 can be secured together by a rope end securing device 109. An example of a suitable rope end securing device 109 includes, but is not limited to nylon tacks, sewing tacks, adhesive, and so forth.

The length of the rope descent device 100 should be of sufficient length to safely secure a user to a fast rope. In one embodiment, the rope descent device 100 is configured to permit the elongated body 101 to wrap around the fast rope to create at least two points of frictional engagement between the fast rope and elongated body 101. In one embodiment, the rope descent device 100 measures about 43 inches in length end-to-end, and measures about 41 inches in length from connection node-to-connection node. In this embodiment, the length of elongated body 101 is about 90 inches, the diameter of the elongated body is about 12.5-13.0 millimeters in diameter, and the strength of the elongated body is about 22 kilo newtons (kN). The elongated body 101 is preferably constructed from a kernmantle low stretch rope such as PMI 12.5 mm HeatShield™, but it can be constructed of any sufficiently durable material capable of withstanding repeated use. Examples of materials, include, but are not limited to nylon, polyester, aramid, polypropylene, High Molecular Density Polyethylene (HMDPE), and so forth.

The rope descent device 100 can also be configured to be heat resistant so that when a user descends a fast rope the friction exerted between the fast rope and elongated body 101 does not cause the elongated body 101 to deteriorate (e.g. melt). As shown in the Figures, the elongated body 101 can be provided with a heat resistant sheath or cover 111. Alternatively, the elongated body 101 may be constructed from a heat resistant material. The heat resistant material can be located at areas where the elongated body 101 interfaces with the fast rope or other areas of the elongated body 101 that may require protection. The heat resistant material can also cover the entire elongated body 101. Suitable heat resistant materials include, but are not limited to, aromatic polyamide (aramid) fibers such as Kevlar®, Nomex® available from DuPont™, Cordura®, CarbonX® available from Chapman Innovations, 343 W 400 S, Salt Lake City, Utah, and so forth.

The connection nodes 104, 105 are configured to secure a user to the rope descent device 100. The connection nodes 104, 105 permit the user to secure the rope descent device 100 to him. For example, a coupling link 203 can be secured to the connection nodes and the user to secure the rope descent device to the user and fast rope. In an embodiment, the connection nodes 104, 105 can be eyelets located at the end of the elongated body 101. The connection nodes 104, 105 can be formed by securing the elongated body 101 to itself at each of its ends 102, 103. Examples of suitable coupling links 203 (as shown in FIGS. 4-9) include, but are not limited to, carabineers such as a Kong Quick Release Carbineer available from KONG s.p.a. Via XXV Aprile, 4 23804 Monte Marenzo LC Italy, a SMC Crossover Triple Lock Carbineer available from Seattle Manufacturing Company 6930 Salashan Parkway Ferndale, Wash. 98248 United States of America, and so forth.

Figure 6:
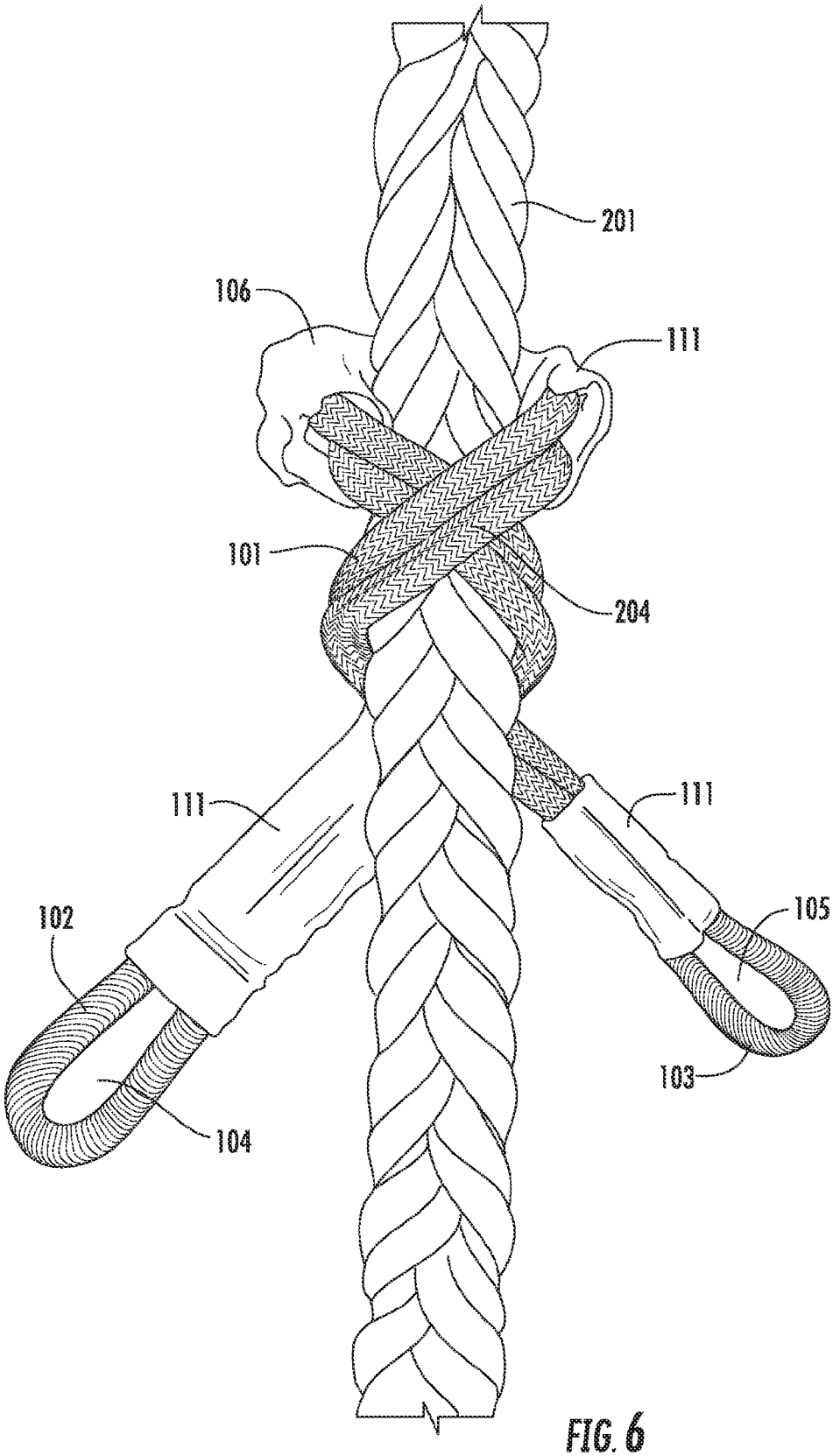
Figure 7:
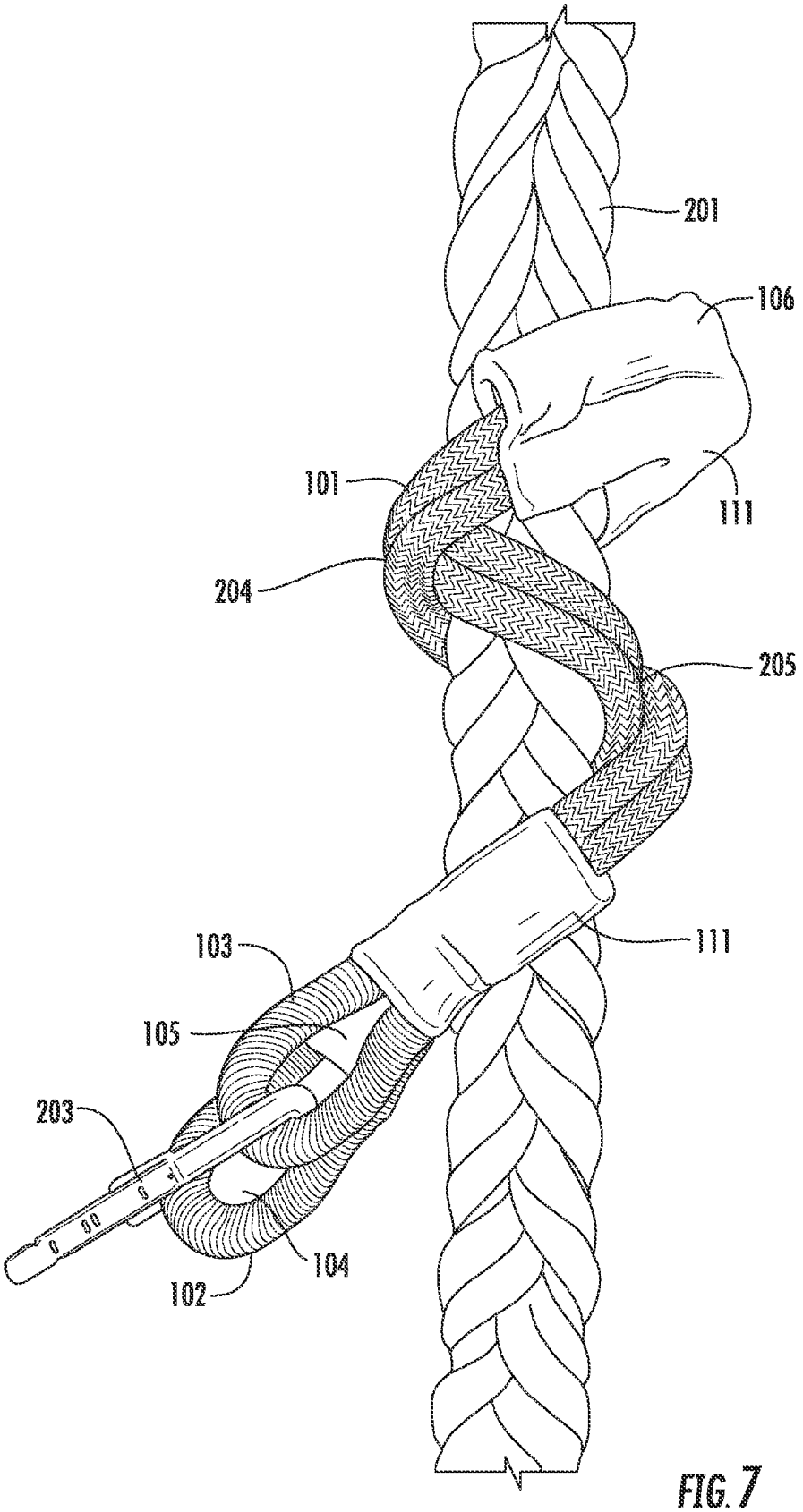
Figure 8:
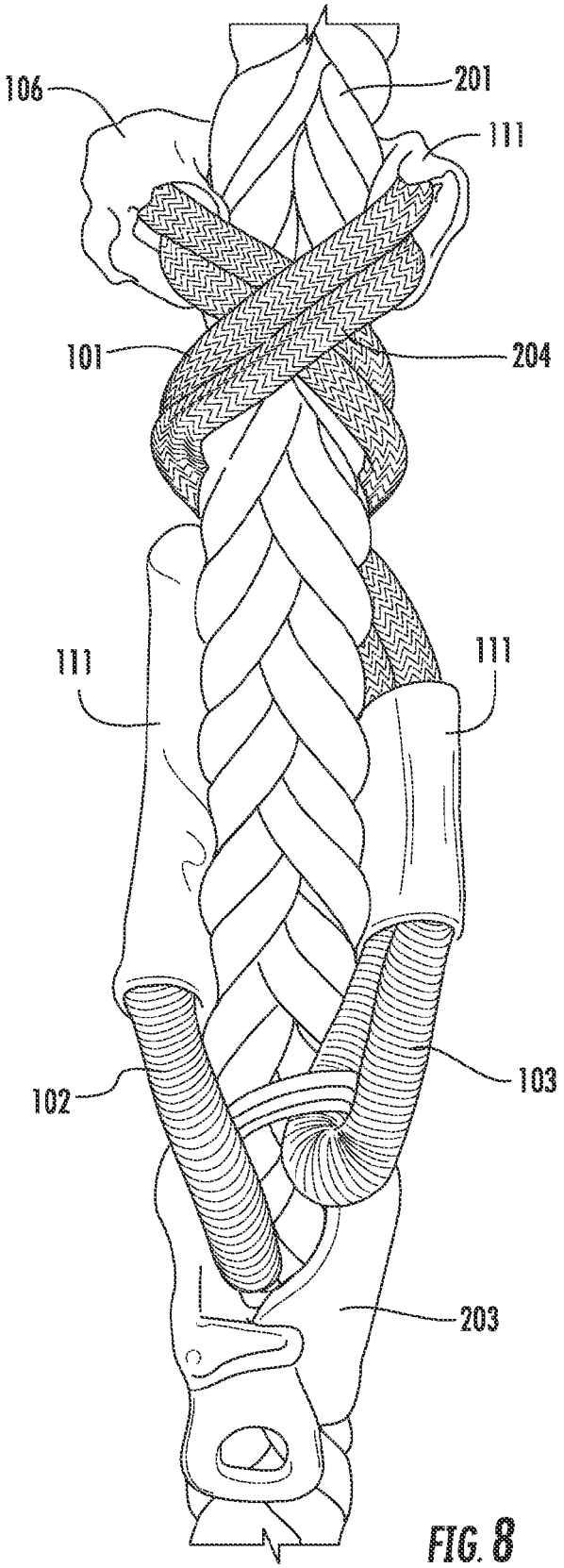
Figure 9:
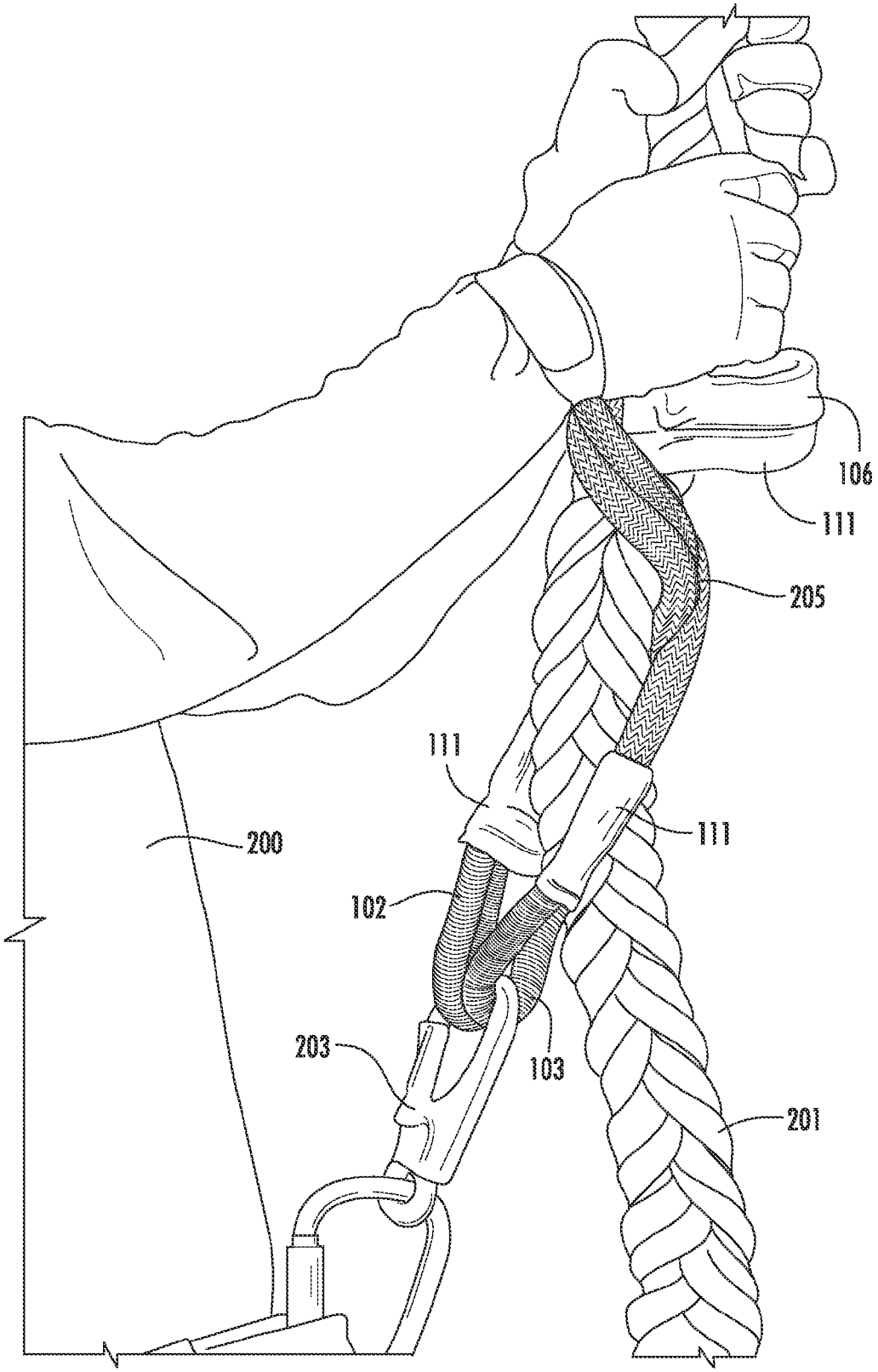

The force release mechanism 106 is configured to release the frictional anchor between the rope descent device 100 and fast rope. The force release mechanism 106 is further configured to permit the user to control their descent rate. In one embodiment, the force release mechanism 106 comprises an elongated portion 110 having a length that is at least about the same as the circumference of the fast rope (e.g., about 1 to 4 inches). The elongated portion 110 can be secured near the midsection of the elongated body 101. Alternatively, the elongated portion 110 can be on or embedded in or border the elongated body 101. The elongated portion 110 may be constructed from any sufficiently elastic material that permits the force release mechanism 106 to bend around the fast rope. To prevent damage due to friction and/or heat, the force release mechanism 106 can be configured to be heat resistant. For example, the force release mechanism 106 can be provided with a heat resistant sheath or cover 111. Examples of materials, include, but are not limited to plastic, rubber, rubber with cordage reinforcement, and so forth In operation, a rope descent device 100 in accordance with this invention may be used to by one or more users to rapidly but safely descend a rope simultaneously while carrying a heavy load or equipment without burning the hands of the user. As shown in FIGS. 4-9, the user 200 obtains a rope descent device 100 and positions the elongated body 101 around a fast rope 201. The mid-section of the elongated body 101 is positioned around the fast rope 201, preferably with the force release mechanism 106 substantially centered on the elongated body 101. The elongated body 101 is wrapped around the fast rope 201 to create at least two points of frictional engagement between the elongated body 101 and the fast rope 201. In one embodiment, the two points of frictional engagement can be created by wrapping the elongated body 101 around the fast rope 201 creating a double-X pattern as shown in FIGS. 6 and 8. The double-X pattern is created as the elongated body 101 crosses itself as the elongated body 101 is wrapped around the fast rope 201. That is, the connection nodes 104, 105 are pulled to the around the fast rope 201 to create a first X pattern 204 and a second X pattern 205.

The rope descent device 100 is then secured to the user by attaching a coupling link 203 to the user and the connection nodes 104, 105. The user can then set the rope descent device 100 by applying a sharp downward pull on the connection nodes 104, 105. The user should maintain constant tension on the device 100. The user can then descend the fast rope 201. The user operates the force release mechanism 106 by exerting a downward force (e.g., sharp downward pull) on the force release mechanism 106. The downward force can be exerted by the user hands. For example, the user may exert the downward force by gripping the rope with their hand and pushing downward with the bottom of their grip. This motion releases the frictional engagement between the elongated body 101 and the fast rope 201 thereby allowing the user to control his rate of descent. The user can control their rate of decent based on the amount of downward force exerted. As the user exerts more downward force, the descent rate increases and vice versa.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A rope descent device comprising:

a. a fast rope;

b. an elongated body wrapped around the fast rope at an angle of at least three hundred and twenty degrees, the elongated body having a first end and a second end;

c. a first connection node at the first end;

d. a second connection node at the second end, wherein the first connection node and the second connection node are configured to connect to a user on a front side of the user; and e. a force release mechanism connected to the elongated body, wherein the force release mechanism is substantially centered on the elongated body between the first end and the second end;

wherein the elongated body is configured to frictionally anchor the elongated body to the fast rope; and the force release mechanism is configured to release the frictional anchorage of said elongated body.

2. The rope descent device of claim 1, wherein the force release mechanism is configured to permit the user to control his descent rate.

3. The rope descent device of claim 2, wherein the connection nodes are configured to be secured to a coupling link.

4. The rope descent device of claim 3, wherein the first connection node and the second connection node are eyelets.

5. The rope descent device of claim 4, wherein the elongated body comprises:

a. a rope having a first terminal and a second terminal, wherein the first terminal of the rope is secured to the second terminal of the rope to form a sling.

6. The rope descent device of claim 4, wherein the elongated body is configured to be heat resistant.

7. The rope descent device of claim 6, wherein the heat resistant material is an aromatic polyamide (aramid).

8. The rope descent device of claim 1, wherein the elongated body is positioned around the fast rope to create a first X pattern.

9. The rope descent device of claim 8, wherein the elongated body is positioned around the fast rope to create a second X pattern.

10. The rope descent device of claim 9, wherein the force release mechanism is positioned higher on the fast rope than the first X pattern and the second X pattern.

11. The rope descent device of claim 1, wherein the elongated body is positioned around the fast rope to create a double-X pattern.

12. The rope descent device of claim 1, wherein the elongated body is wrapped around the fast rope in a double-X pattern to create at least two points of frictional engagement with the fast rope.

13. The rope descent device of claim 1, wherein the elongated body comprises a first rope section extending between the first end and the second end, and a second rope section extending between the first end and the second end.

14. The rope descent device of claim 1, wherein the fast rope has a diameter of between about one inch and about four inches.

15. The rope descent device of claim 1, wherein the force release mechanism comprises a sheath that covers the mid-section of the elongated body.

16. A rope descent device comprising:

a. a fast rope;

b. an elongated body wrapped around the fast rope at an angle of at least three hundred and twenty degrees, said elongated body having a first end and a second end, wherein the first end and the second end are configured to connect to a user on a front side of the user, the elongated body having at least two points of frictional engagement with the fast rope; and c. a force release mechanism secured to the elongated body wherein the force release mechanism is configured to permit the user to control his descent rate, and wherein the force release mechanism is substantially centered on the elongated body between the first end and the second end;

wherein the elongated body is configured to frictionally anchor the elongated body to the fast rope; and the force release mechanism is configured to release the frictional anchorage of said elongated body.

17. The rope descent device of claim 16, wherein the elongated body is wrapped around the fast rope to create a first X pattern.

18. The rope descent device of claim 17, wherein the elongated body is wrapped around the fast rope to create a second X pattern.

19. The rope descent device of claim 16, wherein the elongated body is wrapped around the fast rope to create a double-X pattern.

* * * * *